United States Patent [19]

Fan

[11] Patent Number: 4,941,697

[45] Date of Patent: Jul. 17, 1990

[54] OVER-LOADING IDLING LOCK SET

[76] Inventor: Caesar Fan, 4Fl., No. 102, Fu Chow Rd., Chung Li, Taiwan

[21] Appl. No.: 442,126

[22] Filed: Nov. 28, 1989

[51] Int. Cl.[5] ..... E05B 13/00

[52] U.S. Cl. ..... 292/336.3; 70/218; 70/422; 70/472; 70/476; 74/527; 292/252; 292/359; 292/DIG. 27; 464/36

[58] Field of Search ..... 16/117, 118; 74/527, 74/529; 70/283, 360, 361, 218, 222, 223, 386, 422, 472, 476, 467, 468; 292/252, 336.3, 347, DIG. 27, 359; 464/36

[56] References Cited

U.S. PATENT DOCUMENTS

| | | | |
|---|---|---|---|
| 1,840,682 | 1/1932 | Sheldrick et al. | 464/36 |
| 2,525,340 | 10/1950 | Clark | 292/359 |
| 4,073,518 | 2/1978 | Goodwin | 70/222 X |
| 4,641,868 | 2/1987 | Miron | 292/359 X |
| 4,762,212 | 8/1988 | Fish et al. | 70/283 X |

FOREIGN PATENT DOCUMENTS

| | | | |
|---|---|---|---|
| 103935 | 5/1938 | Australia | 70/360 |

*Primary Examiner*—Lloyd A. Gall

*Attorney, Agent, or Firm*—Asian Pacific Int'l Patent and Trademark Office

[57] ABSTRACT

An over-loading idling lock set having an actuating shaft connected to an indoor lock core and an outdoor sealing block wherein the sealing block is connected to an outdoor lock core, and plural ball members pushed by corresponding restricting springs are disposed between the sealing block and outdoor lock core whereby the ball members are partially extended into corresponding restricting holes formed on the sealing block to associate the outdoor lock core with the sealing block. By means of turning an indoor or outdoor handle, the actuating shaft is rotated to open the lock set. When closing the lock set, a controlling bolt is inserted into a longitudinal groove formed on the indoor lock core to lock the same and thus when turning the outdoor handle, the ball members are separate from the restricting holes due to insufficient spring force. Therefore, the outdoor handle can only idle without opening the lock set. In this position, the lock set can be unlocked via pushing the indoor handle to separate the controlling bolt from the longitudinal groove.

1 Claim, 3 Drawing Sheets

OVER-LOADING IDLING LOCK SET

BACKGROUND OF THE INVENTION

The conventional lock sets are generally divided into two types: the mechanical lock and the electronic lock. The conventional mechanical lock is commonly locked by pressing a button disposed on the inner handle and can be unlocked only via a key. The drawbacks of this kind of lock set are that one must carry the key with himself, and, if the key hole is blocked by foreign article, the key will be invalidated and a locksmith is required to unlock the lock set. However the aforesaid lock set has a simple inner structure and is not apt to be damaged.

The electronic lock set adopts a code device for opening the lock set and is free from the above drawbacks. A slide bolt is disposed within a coil inside the electronic lock whereby a correct code will power on the coil and induce a magnetic field to drive the slide bolt. Then, via rotation of the outdoor handle, the actuating mechanism will retract the latch bolt to unlock the lock. The shortcomings of the above lock set are that the actuating mechanism and slide bolt thereof are quite complicated and must be placed in the door board between the indoor and outdoor handles, and therefore once they are damaged, the whole assembly must be disassembled for repairs.

Therefore, an improved lock set which possesses the advantages of both mechanical and electronic lock sets without drawbacks thereof is developed by the applicant.

SUMMARY OF THE INVENTION

It is a further object of the present invention to provide the above lock set wherein an over-loading idling lock mechanism is substituted for actuating mechanism of prior electronic lock set, serving as a mechanical lock set.

BRIEF DESCRIPTION OF THE DRAWINGS

The present invention can be best understood through the following description and accompanying drawings wherein.

DETAILED DESCRIPTION OF THE PREFERRED EMBODIMENTS

Figure 1:
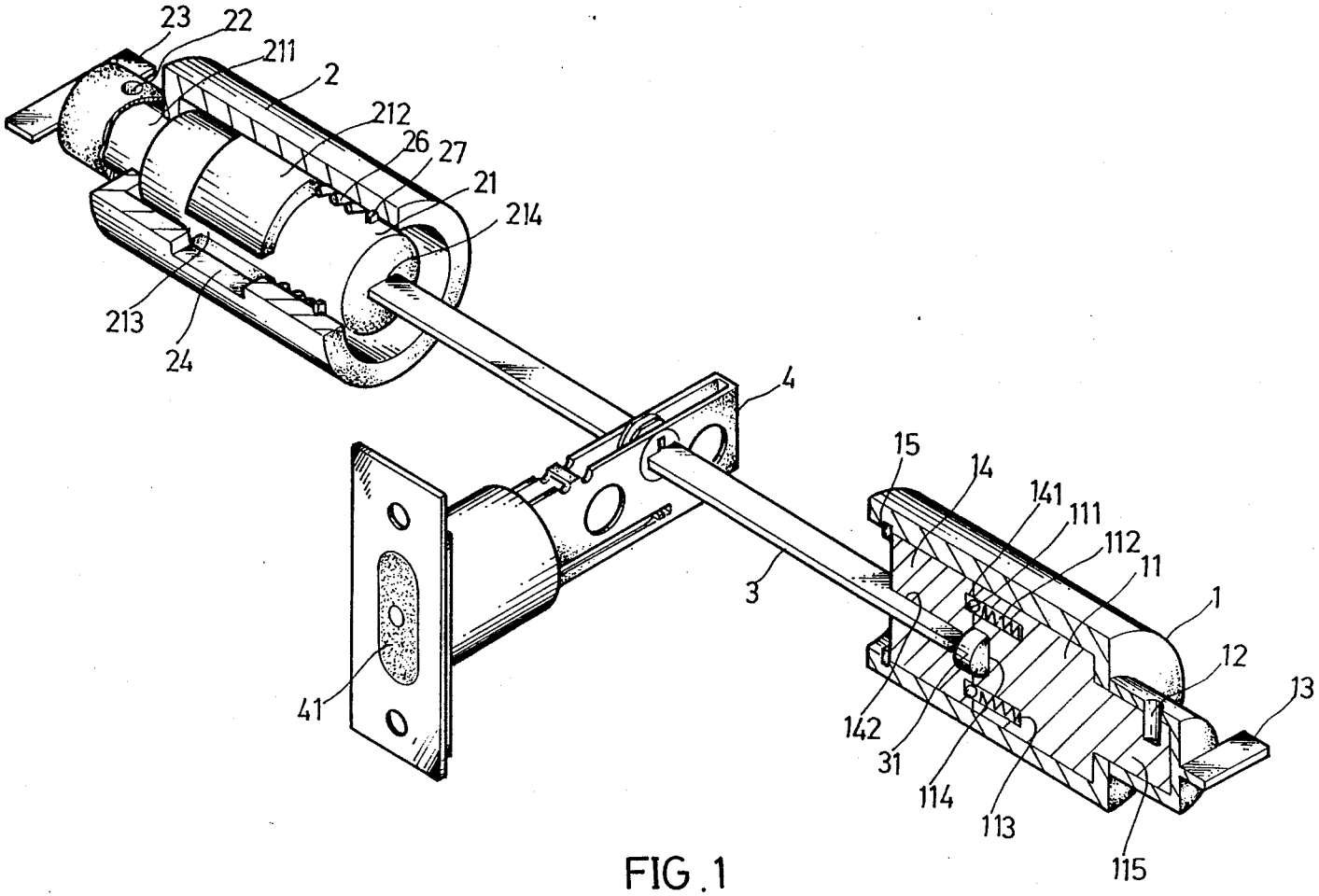
FIG. 1 is a perspective assembled view of the present invention.
Figure 2:
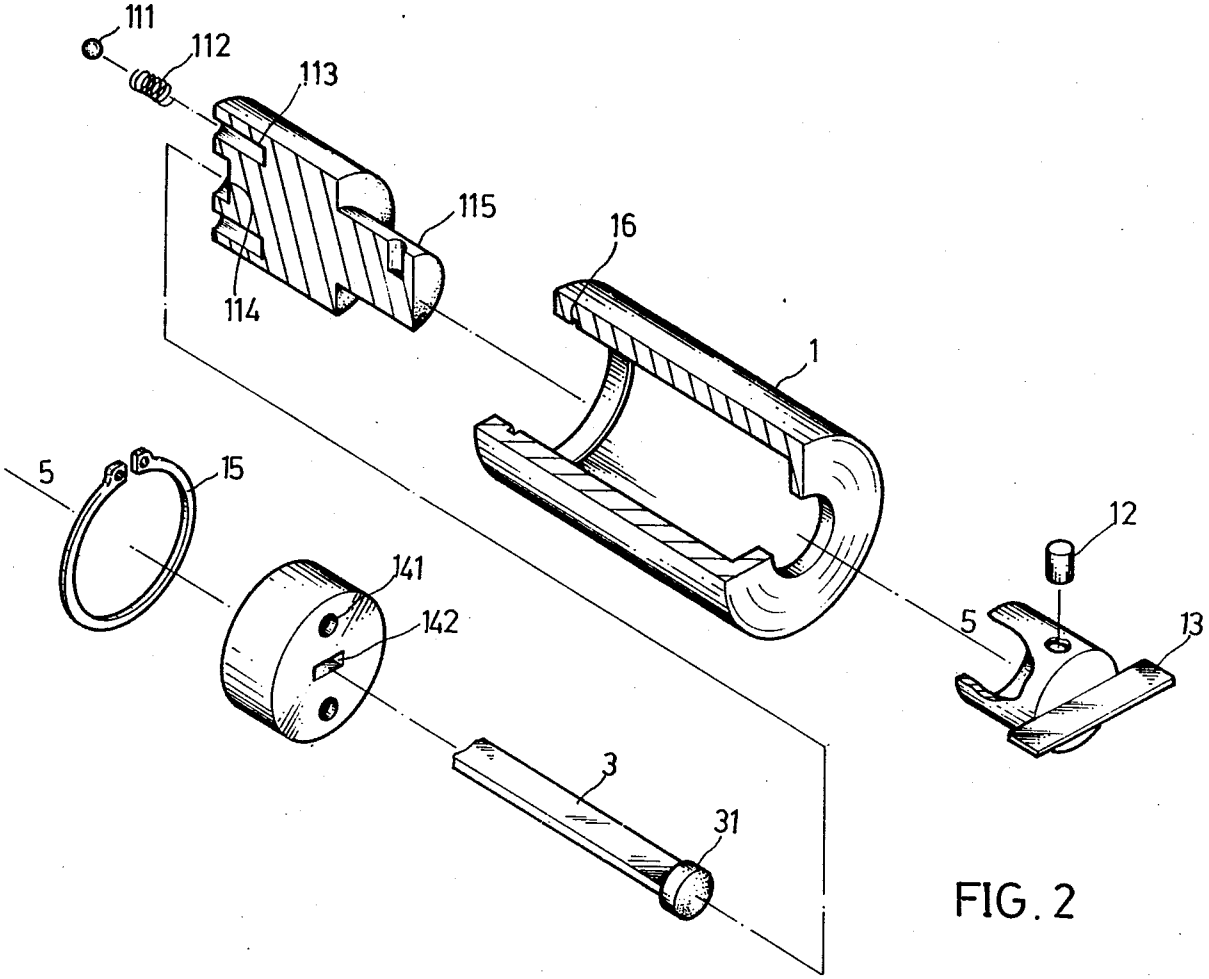
FIG. 2 is an exploded view of the outdoor body.
Figure 3:
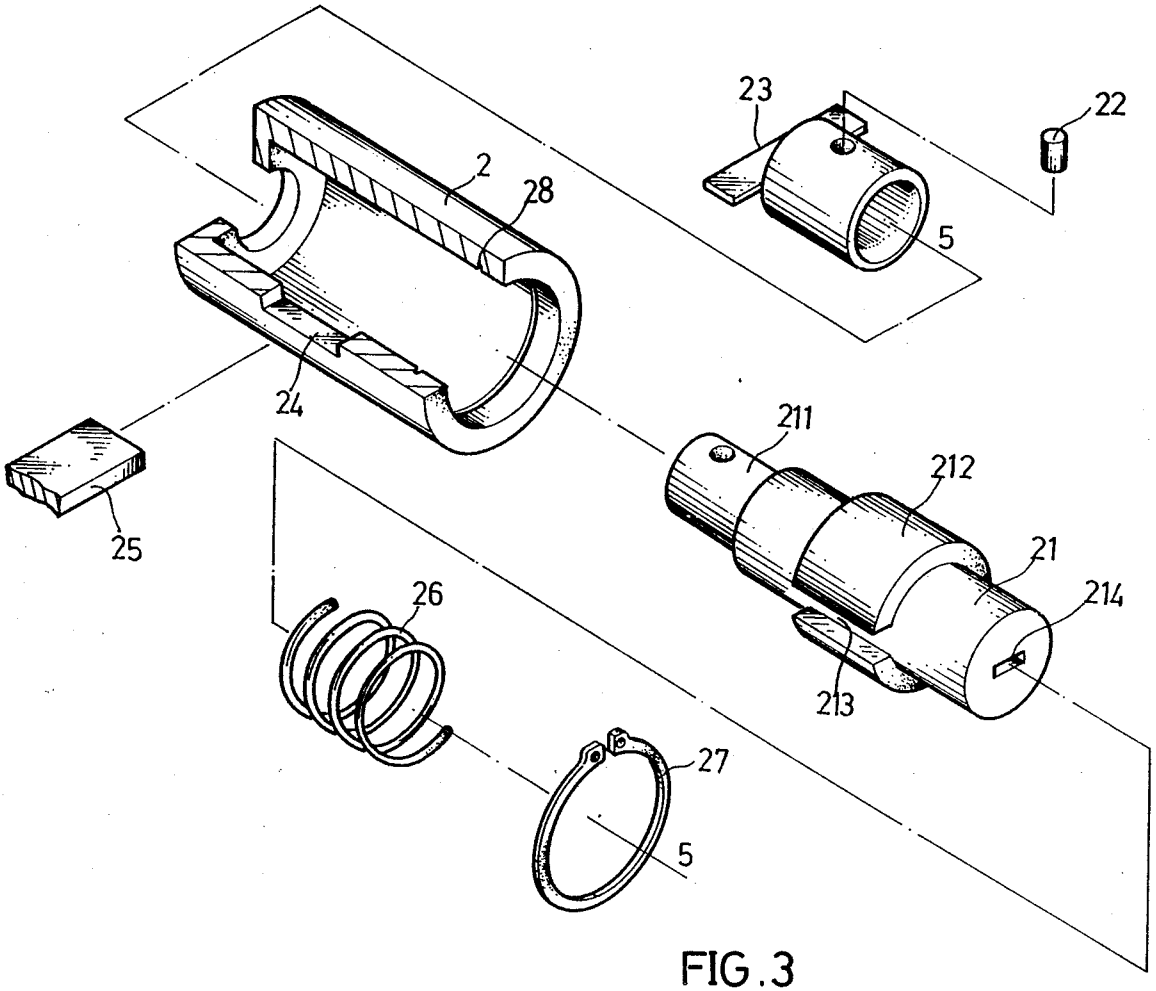
FIG. 3 is an exploded view of the indoor body.

Referring to FIGS. 1 to 3, the present invention is disposed in a through hole formed on a door board, including an outdoor body 1, and indoor body 2 and an actuating shaft 3. The outdoor body 1 is a hollow casing with variable appearance. A cylindrical lock core 11 is rotatably received in the outdoor body 1. The lock core 11 has an axially outward extending projection 115 which protrudes beyond the casing. The projection 115 is connected to an outdoor handle 13 by a key pin 12. Additionally, a sealing block 14 is rotatably disposed in the outdoor body 1. The sealing block 14 is located on the inner side of the lock core 11. The lock core 11 and sealing block 14 can rotate relative to each other. A C-shaped retainer 15 is disposed on a groove 16 of the inner wall of the body 1 adjacent to the inner end surface of the sealing block 14 to prevent the sealing block 14 and lock core 11 from moving away from central axis 5 of the lock core 11.

The inner end surface of the lock core 11 is formed with plural recesses 113 in which a restricting spring 112 and a ball member 111 are disposed. The ball members 111 protrude beyond the lock core 11 and extend into plural restricting holes 141 due to the pushing force of the restricting spring 112. The sealing block 14 is formed with an axial hole 142 corresponding to the actuating shaft 3 whereby the actuating shaft 3 can penetrate the sealing block 14 with its cylindrical end portion 31 received in a circular recess 114 of the lock core 11. Therefore, the actuating shaft 3 will move along with the sealing block 14 without affection of the lock core 11.

The indoor body 2 is also a hollow casing in which a cylindrical lock core 21 is rotatably received. The lock core 21 also has a projection 211 outward extending and protruding beyond the casing. The projection 211 is fixedly connected to an indoor handle 23 by a key pin 22.

An interrupted annular projection 212 is formed on the lock core 21. A longitudinal groove 213 is formed on the interrupted portion of the annular projection 212. A window 24 is formed on the indoor body 2 corresponding to the longitudinal groove 213, permitting a controlling bolt 25 to extend through the window 24 and into the longitudinal groove 213 for restraining the lock core 21 from rotation.

A restoring spring 26 is fitted to the inner side of the annular projection 212.

A C-shaped retainer 27 is disposed on the inner side of the restoring spring 26, and fixed to a recess 28 formed on the inner wall of the body 2. A recess 214 is formed on the inner end surface of the lock core 21 corresponding to the actuating shaft 3. The depth of the recess 214 is larger than the forward travel of the lock core 21. When rotating the lock core 21, the actuating shaft 3 is rotated along with the lock core 21. The restoring spring 26 applies a pushing force on the lock core 21 to make the lock core 21 return to its original position.

Two ends of the actuating shaft 3 are respectively connected to the lock core 21 and sealing block 14. A latch bolt 4 is fitted to the middle portion of the actuating shaft 3. By means of rotating the actuating shaft 3, the latch bolt 4 and the inner linkage thereof (not shown) are driven to retract or extend the dead bolt 41 for opening or closing the lock set.

When the controlling bolt 25 is pulled out from the longitudinal groove 213 and the outdoor handle 13 is rotated, the ball member 11 is extended into the restricting hole 141 due to the pushing force of the restricting spring 112, permitting the sealing block 14, actuating shaft 3 and lock core 21 to rotate and retract the dead bolt 41 for opening the lock set. Similarly, by means of rotating the indoor handle 23, the lock set can be opened.

When closing the lock set, the controlling bolt 25 is inserted into the longitudinal groove 213 to prevent the lock core 21 as well as actuating shaft 3 and sealing block 14 from rotation. Therefore, when rotating the door handle 13 to drive the lock core 11, the restricting spring 112 applies an insufficient pushing force on the ball member 111 so that the ball member 111 is separate from the restricting hole 141, causing the outdoor handle 13 to idle without opening the lock set. This is an over-loading idling design of the present invention.

In this position, by means of pushing the indoor handle 23 to move the lock core 21 forward and separate the controlling bolt 25 from the longitudinal groove 213, and then rotating the indoor handle 23 or outdoor handle 13, the lock set can be opened. Alternatively, the lock set can be opened via pulling up the controlling bolt 25.

Moreover, a code device and simple actuating mechanism are disposed on the door board to vertically operate the controlling bolt 25. The simple actuating mechanism can include a solenoid to actuate the controlling bolt 25. This technique is well known and can be easily done by a person skilled in this art. Therefore, the present invention can apply electrical elements to achieve the same object.

It is apparent that various modifications could be made to the present invention without departing from the basic teachings thereof.

What is claimed is:

1. An over-loading idling lock set comprising:

an outdoor body containing a first rotary lock core connected to an outdoor handle disposed outside said outdoor body, a sealing block being disposed on inner side of said lock core, plural ball members being respectively disposed adjacent contacting surfaces of said lock core and sealing block whereby said ball members protrude beyond said lock core and extend into restricting holes, a C-shaped retainer being disposed on inner side of said sealing block and fixed to said outdoor body;

an indoor body containing a second rotary lock core connected to an indoor handle disposed outside said indoor body, an interrupted annular projection being formed on said second lock core, forming a longitudinal groove suitable for receiving a vertically movable controlling bolt, a restoring spring being disposed on inner side of said annular projection, a C-shaped retainer being disposed on inner side of said restoring spring and fixed to said indoor body; and an actuating shaft, connected to said sealing block and second lock core, capable of driving a latch bolt to open said lock set, whereby when said controlling bolt is inserted into said longitudinal groove to prevent said second lock core from rotation, a restricting spring applies an insufficient pushing force on said ball members so that said ball members are separate from said restricting holes, causing said outdoor handle to idle without opening said lock set, while when said controlling bolt is pulled out from said longitudinal groove, said ball members are effectively extended into said restricting holes due to sufficient pushing force of restricting springs, and said lock set may be opened by means of rotating said indoor handle and outdoor handle, said second lock core may be pushed forward without pulling up said controlling bolt to move said second lock core forward and separate said controlling bolt from said longitudinal groove, permitting said second lock core to freely rotate whereby by means of rotating said indoor and outdoor handles, said lock set is opened.

* * * * *